United States Patent [19]

Whiteford

[11] 4,311,070

[45] Jan. 19, 1982

[54] DOUBLE ENDED ADJUSTABLE WRENCH

[76] Inventor: Carl Whiteford, 3 High Point Rd., Westport, Conn. 06880

[21] Appl. No.: 150,209

[22] Filed: May 15, 1980

[51] Int. Cl.[3] ..... B25B 13/10

[52] U.S. Cl. ..... 81/77

[58] Field of Search ..... 81/77, 163, 165, 170, 81/172

[56] References Cited

U.S. PATENT DOCUMENTS

| | | | |
|---|---|---|---|
| 96,203 | 10/1869 | Coes | 81/77 |
| 765,052 | 7/1904 | Stevenson | 81/77 |
| 3,901,107 | 8/1975 | Halls | 81/165 X |
| 4,028,970 | 6/1977 | Pelczar | 81/165 |

*Primary Examiner*—James G. Smith

*Attorney, Agent, or Firm*—Martin D. Wittstein

[57] ABSTRACT

A double ended adjustable wrench for turning nuts, bolts, pipe and the like. The wrench is generally elongated in the manner of a conventional adjustable wrench, but the body of the wrench is made up of two substantially identical sections which are connected together for relative lateral movement toward and away from each other. The opposite ends of each section are appropriately shaped so that they cooperate with each other to define jaws which open and close as the two body sections move laterally. A mechanism is provided for movably connecting the two body sections together and for adjustably moving them relative to each other in order to open the jaws in a parallel manner a desired amount within predetermined limits. The jaws at one end are larger than the jaws at the other end, and at least one end of the wrench includes serrated jaws, so that a single wrench constructed in accordance with the principles of the invention replaces at least two if not three standard adjustable wrenches.

7 Claims, 6 Drawing Figures

FIG. 4
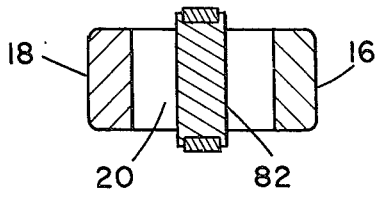
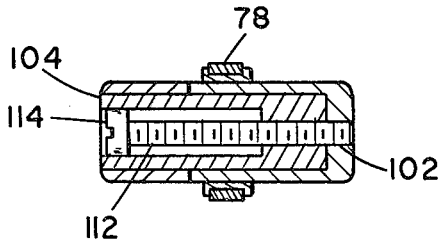
FIG. 5
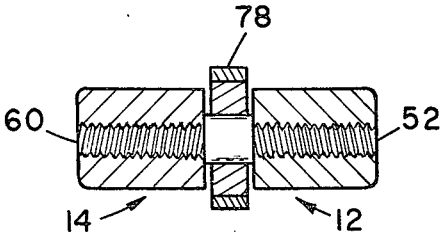
FIG. 6
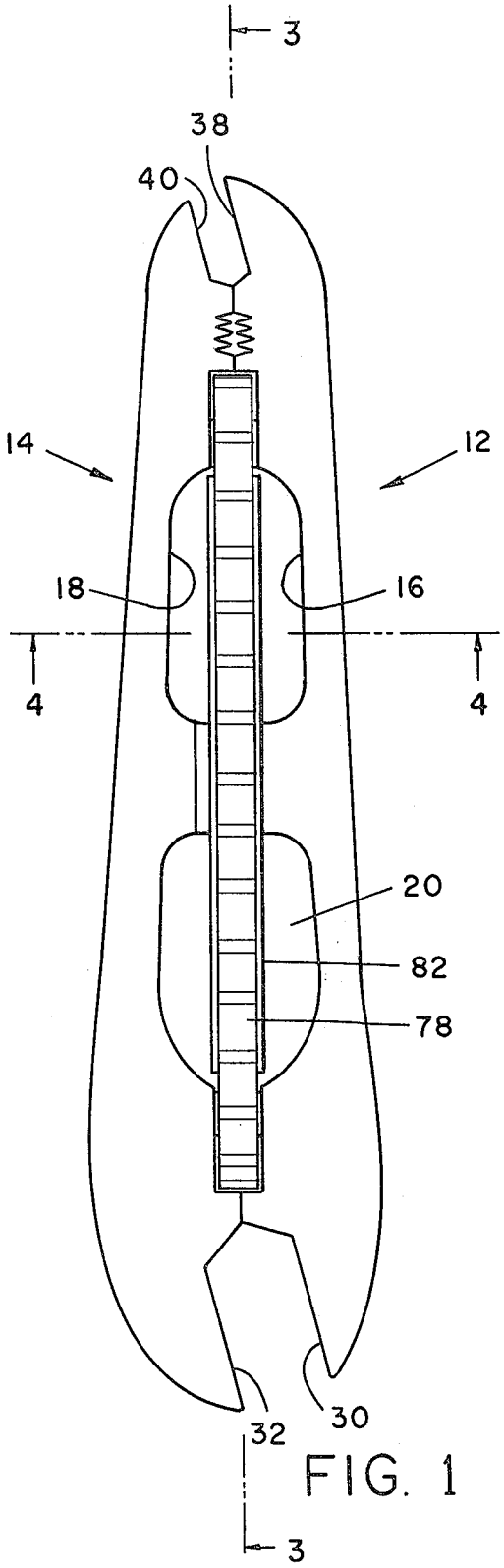
FIG. 1

DOUBLE ENDED ADJUSTABLE WRENCH

BACKGROUND OF THE INVENTION

One of the most familiar and frequently used hand tools is the adjustable wrench, which is a tool for turning various shaped members, such as bolts, nuts, pipe, etc., where great resistance to turning is usually encountered. Although there are number of relatively sophisticated wrenches which are designed for special purposes, one of the most versatile is the simple adjustable crescent wrench, which is available in three or four different sizes. The single most significant advantage of an adjustable wrench over a fixed or single size wrench is that a single adjustable wrench can be used on any bolt or nut from the smallest size possible up to the maximum size to which the wrench can be opened. Thus, one adjustable wrench may take the place of several fixed wrenches and still be able to fit hardware which would be impossible to fit with a fixed wrench.

Although adjustable wrenches can be found in a variety of shapes and design, they are all basically of the same general arrangement. A fixed jaw is mounted on or formed intregrally with an elongate handle, and a movable jaw is mounted by suitable means, such as a groove or trach, for movement toward and away from the fixed jaw. Typically, a knurled driver is rotatably mounted on the wrench in a location where it can be easily turned by an operator, the driver being either internally or externally threaded. The movable jaw has a portion provided with teeth or tooth segments, usually arranged as a rack, which are complimentary to the thread on the driver, the arrangement being such that rotation of the driver by an operator is translated into linear movement of the movable jaw, thus permitting the space between the jaws to be adjusted within the limits of the particular wrench.

A principal disadvantage of wrenches of the type described above is that it is difficult to maintain a given separation of the jaws with any degree of precision due to the fact that the threads on the driver and the teeth or tooth segments on the rack are relatively large and there is considerable free play between the driver and the movable jaw rack. This degree of free play or looseness is necessary to make the wrench easy to adjust, whereas, a more precise fit and closer tolerance on these parts would make the wrench much harder to adjust. As a consequence, an operator is usually constantly adjusting the wrench while using it to turn the same size nut.

Another disadvantage is that the thread pitch on the driver and on the rack is coarse to permit the wrench to be adjusted rapidly since the driver is rotated with just the thumb and forefinger. With a fine thread pitch, it would take so long to make large adjustments to the wrench that the average user would become exasperated, even though a wrench with a fine thread pitch could be more precisely adjusted and might hold a given adjustment tightly enough to remain locked onto a bolt head or a nut.

Still another disadvantage of a conventional adjustable wrench is that the threads on the driver and the teeth or tooth segments on the rack become so rusty, corroded or dirty after extensive use that it is extremely difficult to turn the driver. Often it becomes necessary to actually push the movable jaw while simultaneously rotating the driver in order to adjust the wrench. While it would seem that a few drops of oil might solve this problem, this is not the case because either the driver, the rack or both are exposed and are touched during normal operation of the wrench, with the obvious result that the oil or other lubrication, along with the rust, corrosion or dirt, would get on the user's hands.

Another disadvantage of conventional adjustable wrenches is that they must be made in several different sizes, usually every two inches from four to twelve inches of handle length, depending on the range of the jaw opening and the anticipated torque which the wrench is designed to withstand. This is particularly true of the well known crescent-wrench which has a somewhat limited jaw size range because of the limited amount of movement of the movable jaw.

BRIEF SUMMARY OF THE INVENTION

This invention relates generally to the field of hand wrenches and more particularly to a double-ended adjustable wrench.

The foregoing disadvantages and shortcomings of conventional adjustable wrenches have been obviated if not eliminated by the present invention, the principles of which are embodied in a wrench which can be precisely yet quickly adjusted to any desired size, and will hold with sufficient grip that the wrench will stay in place even if it is released by the user and will not move out of adjustment while it is being used. Also, all movable operating steel parts are isolated from contact by the user so that these parts can be lubricated without the chance of only lubricant getting on the user's hands.

In its broader aspects, a wrench embodying the principles of the Present invention comprises an elongate body adapted to be held in the hand of a user, the body comprising two substantially identical body members disposed in longitudinally facing relationship. The opposite end portion of each body member are so shaped as to cooperate with the end portions of the other body member to define jaws at opposite ends of the body for receiving the member to be turned. A suitable means is provided for connecting the body members together for causing relative lateral movement toward and away from each other, and a further means is operatively connected to the connecting means for actuating the latter to move the body members toward and away from each other with the result that the jaws at opposite ends of the body are adjustably opened or closed simultaneously and in a parallel manner.

In a presently preferred embodiment of the invention, the connecting means is achieved by using a pair of threaded rods located adjacent opposite ends of the body, each rod being threaded in an opposite direction from the center outwardly, as in the manner of a conventional turnbuckle rod. Each end of each rod is received within a correspondingly threaded bore in the body members with the result that, when the rods are simultaneously rotated in one direction, the body members move away from each other, thereby opening the jaws, and when the rods are simultaneously rotated in the opposite direction, the body members move toward each other thereby closing the jaws.

The rods are rotated simultaneously by providing an enlarged portion at the center of each rod with teeth or ridges, such as a pulley or gear, and by passing a flexible belt around the two gears so that movement of the belt longitudinally in one direction or the other rotates both rods, precisely the same amount. The opposite runs of the belt are suitably supported in a plane slightly raised above the surface of the body members of the wrench to facilitate rapid movement of the belt by the user either with his fingers or by simply moving the wrench along a suitable surface which is engaged by and frictionally moves the belt. The member supporting the belt is itself maintained in operative position by being in sliding contact with the gears, the supporting member having side flanges engaging the sides of the gears so that it cannot shift laterally. Suitable guiding means is provided between the ends of the wrench to assure that the two body sections do not move longitudinally relative to each other which would cause the threaded driving rods to bind in the body sections and damage the wrench. This guiding means also serves to limit the amount by which the wrench can be opened so that the body sections do not completely separate.

With the above features of construction, it will be apparent that a wrench embodying the principles of the present invention has advantageous and unique features not heretofore possible in prior art wrenches. The present invention makes it possible to accomplish with one tool what could only be done heretofore with at least two and more likely three or more tools. The wrench of the present invention is more precise, more easily adjustable and grips tightly if desired. It can be maintained in clean and smoothly operating condition more easily than known wrenches, and is more economical.

Having briefly described the general nature of the present invention, it is a principal object thereof to provide an improved adjustable wrench which avoids the disadvantages of prior art adjustable wrenches and incorporates certain new advantages.

It is a more specific object of the present invention to provide an adjustable wrench which is highly accurate and reliable in the manner of setting the wrench jaws, which remains fully operable with no maintenance over any period of use and which is very versatile in its utility.

These and other objects and advantages of the present invention will become more apparent from an understanding of the following description of a presently preferred embodiment of the invention when considred in conjunction with the accompanying drawings in which:

FIG. 1 is a plan view of an adjustable wrench embodying the principles of the invention, with the wrench shown in a closed position;

FIG. 4 is a cross-sectional view of the wrench, at an intermediate point along its length, showing the belt and track;

FIG. 5 is a cross-sectional view of the wrench shown at the center of the anti-skew means and showing the limiting stop bolt;

FIG. 6 is a cross-sectional view of the wrench, shown at the center of one of the threaded actuating rods.

DETAILED DESCRIPTION OF THE INVENTION

Figure 2:
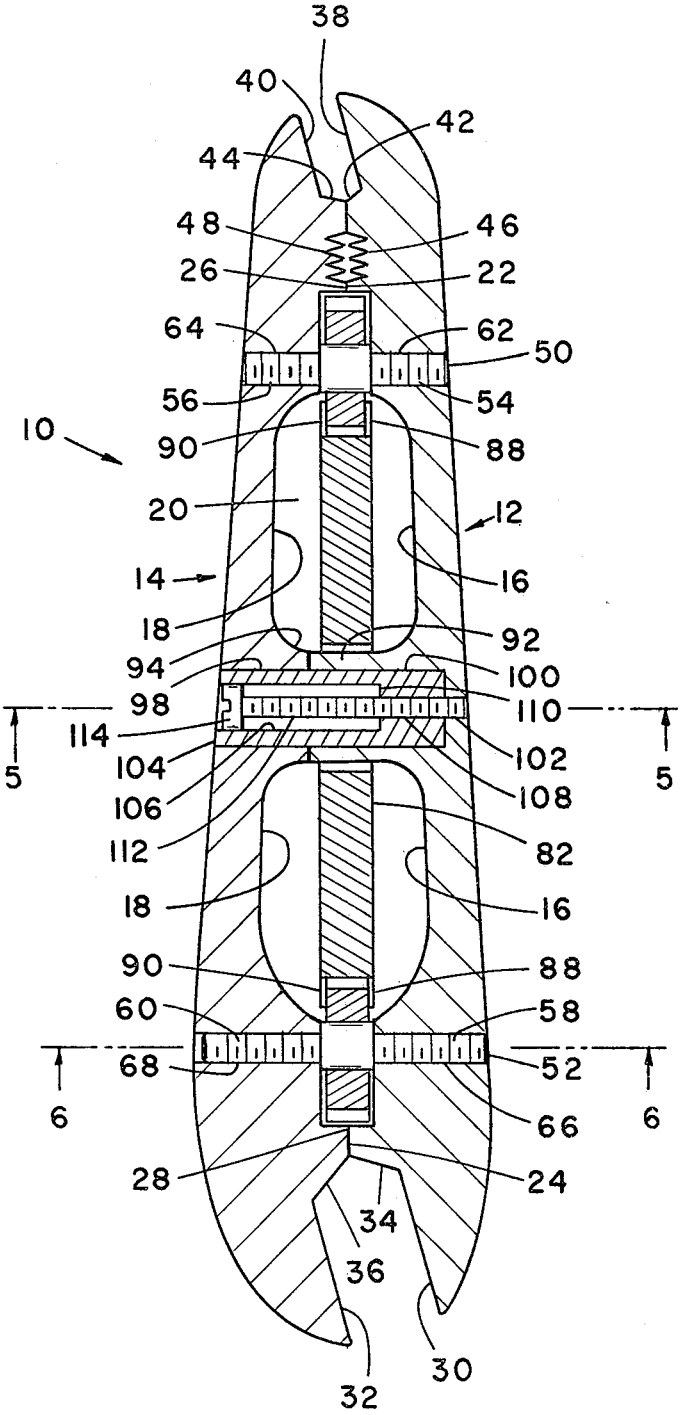
FIG. 2 is a longitudinal sectional view of the wrench shown in FIG. 1, showing the wrench in a partly open position.

Referring to the drawings, and particularly to FIGS. 1 and 2 thereof, the reference numeral 10 generally designates an adjustable wrench incorporating the principles and features of the present invention. The wrench 10 comprises an elongate body comprised of two substantially identical body members generally designated by the numerals 12 and 14. The body members 12 and 14 include elongate recesses 16 and 18 respectively extending longitudinally along a portion of the inner edge of the body members, the recesses 16 and 18 cooperating with each other to define an elongate space 20 within the body proper. A pair of short longitudinal walls 22 and 24 on the body member 12 at opposite ends of the recess 16 abut a corresponding pair of similarly located walls 26 and 28 on the body member 14 to define an innermost or closed position of the wrench 10 with respect to lateral movement of the body members 12 and 14 as more fully explained below.

At one end the body members 12 and 14 have longitudinal walls 30 and 32 which join the angled walls 34 and 36 to define jaws which are adapted to receive hardware to be turned. The jaws illustrated are particularly adapted to receive hex nuts or bolts, and other jaw configurations are contemplated within the scope of the invention. Similarly, at the opposite end, the body segments 12 and 14 have longitudinal walls 38 and 40 which join with angled walls 42 and 44 to define similar jaws. At this end of the wrench, the body member 12 is provided with a serrated wall 46 which cooperates with a similarly serrated wall 48, formed on the body member 14 to define opposed cooperating teeth generally disposed in an arc, which can grip a smooth surfaced round member such as pipe in the manner of a conventional pipe wrench. Similar pipe wrench serrations may be provided at the opposite end if desired. It will be apparent that, since the body segments 12 and 14 can be separated, as explained below, within a fixed range depending on the overall size of the wrench, the jaws at opposite ends of the wrench will accommodate nuts over two entirely distinct ranges of sizes. Since these ranges can be made to extend beyond ranges of conventional wrenches, it is possible for the wrench of this invention to replace 3 different sizes of conventional wrenches, and also function as a small pipe wrench.

The body members 12 and 14 are connected together by a mechanical means which causes the body members to move laterally toward and away from each other. In the embodiment illustrated, this means comprises a pair of rods 50 and 52 which extend laterally relative to the body and which have threaded portions 54 and 56 for the rod 50 and threaded portions 58 and 60 for the rod 52. These end portions are received within correspondingly threaded bores 62, 64, 66 and 68 respectively formed in the body members 12 and 14. The threads on the end portions 54 and 56 of the rod 50 are chased in opposite directions, and the threads on the bores 62 and 64 are correspondingly tapped in opposite directions. The identical thread arrangement is provided on the end portions 58 and 60 of the rod 52 and in the bores 66 and 68. Thus, it will be apparent that, if the rods 50 and 52 are rotated in one direction, the body members 12 and 14 will be moved laterally away from each other in order to open the jaws at the opposite ends of the wrench body, and if the rods 50 and 52 are rotated in the opposite direction, the body members 12 and 14 will be moved toward each other to close the jaws.

It should be noted that the threaded rods 50 and 52 are located at adjacent opposite ends of the body members 12 and 14 so as to provide both the maximum degree of lateral and longitudinal stability to the body members 12 and 14 and to assure the greatest possible accuracy in setting the jaws at either end to a particular size.

Figure 3:
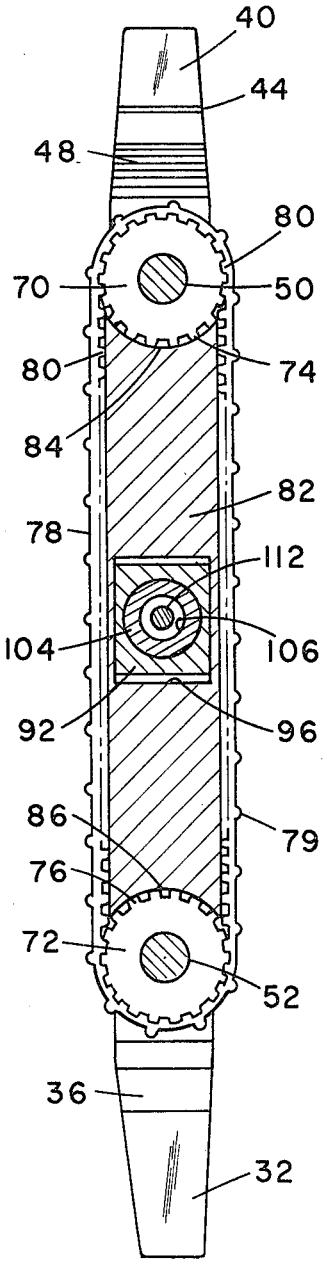
FIG. 3 is a longitudinal side sectional view of the wrench shown in FIG. 1 taken on the line. 3—3 of FIG. 1.

Means are provided for rotating both of the rods 50 and 52 simultaneously in the same direction and by the same amount so that both of the body members 12 and 14 move toward and away from each other simultaneously by the same amount at both ends. As best seen in FIG. 3, each rod 50 and 52 has an enlarged central portion 70 and 72 respectively, which are belt drive pulleys preferably formed as timing gears and provided with a suitable form of teeth 74 and 76 respectively. An endless flexible belt 78, having outwardly protruding, spaced apart rubber-like gripping teeth 79, which may have any desired shape, extends around both rods 50 and 52 and has suitable teeth 80 which engage with the teeth 74 and 76 in driving relationship. Thus, if the belt 78 is moved longitudinally in either direction, the rods 50 and 52 are rotated in one direction or the other simultaneously and in synchronism. It will be apparent that any flexible member having a driving configuration, such as apertures, teeth, ridges, grooves, etc. can be used with rods having a correspondingly shaped configuration on the enlarged portions 70 and 72, and that the particular arrangement shown is for illustrative purposes only.

A belt support and guide member 82 is provided to support the opposed straight runs of the belt 78 so that they are not depressed into the space 20 when the belt is being moved. As best seen in FIGS. 2 and 3, the belt support and guide member 82 is elongate and extends the distance between the belt pulleys 70 and 72. The opposite ends 84 and 86 of the belt guide member 82 are curved to have an internal diameter which is equal to the external diameter of the belt pulleys 70 and 72 so that the ends 84 and 86 of the belt guide member are in sliding contact with the periphery of the teeth 74 and 76 of the pulleys 70 and 72 respectively when the latter are rotated by the belt 78. The belt guide member 82 has flanges 88 and 90 (FIG. 2) which extend entirely around the periphery of the belt guide member on both sides thereof and which are therefore disposed on opposite sides of the belt pulleys 70 and 72. It will be apparent that the belt guide member 82 cannot move either longitudinally or laterally because of the arcuate ends 84 and 86 contacting the peripheral portion of the belt pulleys 70 and 72, and the flanges 88 and 90 contacting the outer surfaces of the belt pulleys 70 and 72. The belt guide member 82 is additionally supported at its midpoint so that it cannot move or bend in a plane normal to the plane of the wrench. This support is provided by a relatively wide, flat sided protuberance 92 which extends from the body member 12 into the space 20 and which extends almost to the body member 14 where it abuts a similarly shaped but much shorter protuberance 94 extending into the space 20 from the body member 14. The belt guide member 82 is provided with a rectangular opening 96 which is a little larger than the width of the protuberance 92 but is substantially equal to the thickness of the protuberance 92 so that the opening 96 makes a close sliding fit with the protuberance 92 on the flat surfaces thereof. Thus, the protuberance 92 supports the belt guide member 82 throughout all of the range of movement of the body member 12.

In order to assure that the threaded rods 50 and 52 continue to operate smoothly in the threaded bores and that there is no binding which would cause thread damage, the wrench includes means for providing substantial structural rigidity to the central portion of the wrench so that the body sections cannot move longitudinally relatively to each other or, in other words, skew from a purely lateral direction of movement. The longitudinal movement or skew would otherwise be caused by the 15° offset angle from the longitudinal axis of the wrench to which the jaws at the opposite ends of the wrench are set. This offset is clearly seen in FIG. 1 and 2 and is standard practice in wrench design to facilitate use of the wrench is cramped places where the wrench can be inserted more easily in one direction than in the other.

The anti-skew mechanism includes a bore 98 extending through the protuberance 94 and another bore 100 extending partially through the protuberance 92 and terminating in a short, much smaller diameter threaded bore 102. A stub shaft 104 is held in the bore 98 with a press fit so that the stub shaft 104 is fixedly mounted in the body member 14. The bore 100 in the protuberance 92 receives the stub shaft 104, and connects with a smaller bore 108 extending the rest of the way through the stub shaft 104. The difference in diameter between the bores 106 and 108 defines an abutment 110. A bolt 112 having a head 114 is received within the bore 106 and the bore 108 and is threaded into the threaded bore 102. It will be apparent from the above description that the very close tolerance sliding fit between the bore 100 and the outer surface of the stub shaft 104 provides a substantial amount of rigidity to the central portion of the wrench and thereby prevents any relative longitudinal movement of the body members 12 and 14. Of course, the rods 50 and 52 will provide a certain amount of rigidity to prevent skew of the body members but the above described structure provides considerably more and makes the wrench very stable and able to effectively withstand high torque forces.

In addition to the anti-skew function of the structure just described, it also provides a limit stop to limit the extent to which the wrench can be opened and thereby prevents the wrench from coming apart. It will be seen from FIG. 2 that, as the body members 12 and 14 are separated by moving the flexible belt 78, the bolt 112 is moved with the body member 12, the head 114 of the bolt moving freely in the bore 106 until the inner surface of the head 114 abuts the bottom surface 110 of the bore 106. At that point the body members cannot separate further and the jaws of the wrench are at the maximum opening. It it is desired to disassemble the wrench, it is necessary only to unscrew the bolt 112 from the body member 12 and then continue to separate the body members 12 and 14 until the threaded portions of the rods 50 and 52 become clear of their respective threaded bores.

I claim:

1. A double ended adjustable wrench comprising:

A. an elongate body adapted to be held in the and of a user, said body comprising two substantially identical body members disposed in longitudinally facing relationship, B. opposite end portions of each body member being so shaped as to cooperate with the end portions of the other body member to define jaws at opposite ends of said body for receiving a member to be turned, C. means located adjacent opposite ends of said body for connecting said body members together for causing relative lateral movement of both ends of said body members toward and away from each other, and D. means operative connected to both said connecting means for actuating both said connecting means in synchronism to move said body members toward and away from each other simultaneously whereby said jaws at opposite ends of said body are adjustably opened or closed simultaneously.

2. A wrench as set forth in claim 1 wherein said means for connecting said body members together comprises a pair of rods located adjacent opposite ends of said body and extending into bores formed in said body members, said rods and said bores being correspondingly threaded in one direction in one of said body members and being correspondingly threaded in the opposite direction in the other of said body members, and wherein said means for actuating said connecting means comprises means located intermediate said rods and operatively connected to both said rods for rotating both of said rods simultaneously in the same direction.

3. A wrench as set forth in claim 2 wherein said means for simultaneously rotating both of said rods comprises a flexible endless belt extending around both of said rods and having means forming a driving engagement with said rods whereby longitudinal movement of said endless belt causes simultaneous rotation of said rods.

4. A wrench as set forth in claim 3 wherein said means for actuating said connecting means further comprises support means for said flexible belt, said support means being mounted between said body members and extending between said rods and providing opposed supporting surfaces for said belt which are spaced apart a distance greater than the thickness of said body members thereby maintaining the opposite runs of said belt accessible for manual grasping.

5. A wrench as set forth in claim 4 wherein said belt support means includes arcuate end portions disposed in sliding engagement with a portion of said connecting rods and an aperture intermediate said end portions which is in sliding engagement with a supporting protuberance projecting from one of said body members through said apertures.

6. A wrench as set forth in claim 2 wherein said connecting means further includes means disposed centrally between said rods and interconnecting said body members for preventing relative longitudinal movement between said body members in response to a torque applied to said wrench, said means for preventing said relative longitudinal movement comprises a protuberance projecting from one of said body members and abuting the other body member, a stub shaft fixedly secured to said other body member, and a bore formed in said protuberance to have a close tolerance sliding fit with said stub shaft as said body members are separated by rotation of said rods.

7. A wrench as set forth in claim 6 wherein said means for preventing said longitudinal movement further comprises means for limiting the extent to which said body members can be separated, said means comprising a bore formed in said stub shaft and having an abutment therein, and an elongate member having one end secured to said one body member for movement therewith relative to said bore, said member having a corresponding abutment adjacent the other end thereof for engagement with the abutment in said bore to limit the outward movement of said body members.

* * * * *